United States Patent [19]

Terry, deceased et al.

[11] 4,128,117

[45] Dec. 5, 1978

[54] LOG PREPARING APPARATUS

[76] Inventors: James A. Terry, deceased, late of Delaware County, Ohio; Barbara P. Russell, heir, 2354 Marion Bucyrus Rd., Marion, Ohio 43302; James F. Terry, heir, 50 Homestead Ln., Delaware, Ohio 43015; Shirley A. Cain, heir, 260 Belvedere, Columbus, Ohio 43223

[21] Appl. No.: 818,566

[22] Filed: Jul. 25, 1977

[51] Int. Cl.[2] ..... B27L 7/00

[52] U.S. Cl. ..... 144/3 K; 83/928; 144/193 A

[58] Field of Search ..... 144/3 K, 193 R, 193 A, 144/194, 322, 326; 254/104; 83/928

[56] References Cited

U.S. PATENT DOCUMENTS

| | | | |
|---|---|---|---|
| 3,862,651 | 1/1975 | Heikkinen | 144/193 A |
| 3,974,867 | 8/1976 | Butas, Jr. | 144/193 A |
| 3,995,672 | 12/1976 | Binninger | 144/193 A |

FOREIGN PATENT DOCUMENTS

| | | | |
|---|---|---|---|
| 519901 | 2/1921 | France | 144/3 K |
| 421504 | 12/1974 | U.S.S.R. | 144/193 A |

*Primary Examiner*—Othell M. Simpson
*Assistant Examiner*—W. D. Bray
*Attorney, Agent, or Firm*—Sidney W. Millard; Gerald L. Smith

[57] ABSTRACT

A trailer mounted apparatus for preparing logs for fireplace usage which includes an assembly frame upon which a hydraulic ram is mounted in alignment with an elongate platform for receiving logs to be split. The ram is actuated to engage one side of the log and urge it into a composite log splitting wedge assembly mounted upon the frame. The wedge assembly includes a vertical wedge positioned coaxially with the ram and elongate platform as well as two transversely oriented horizontal wedges, the splitting edges of which are arranged at an acute angle with respect to the ram axis of splitting. The elongate platform is arranged to taper to a terminus located at the entrance to the composite wedge assembly. A receiving platform is positioned beneath both the elongate platform and the wedge assembly for collecting log segments as they are split. The trailer mounted assembly further incorporates a circular saw positioned upon a saw frame which is pivotally mounted upon an assembly frame.

9 Claims, 7 Drawing Figures

LOG PREPARING APPARATUS

BACKGROUND

The splitting of logs for fireplace utilization and the like long has been considered a highly physically taxing enterprise. Attempts to minimize this labor intensive effort have led to a broad variety of devices. Such devices usually utilize some form of hydraulic actuation to carry out the splitting procedure, inasmuch as considerable force applied over a relatively short drive length is required. Application of the force generally has followed either of two arrangements, the first providing for the driving of either a blade or a wedge through the log being split and the second providing for the driving of the log into a stationary blade or a wedge. The former approach, typified in U.S. Pat. Nos. 3,640,323 or 3,508,221 evidences impracticalities inasmuch as the splitting mechanism must be capable of being driven entirely through the log while the log remains securely restrained against movement. Where cross-grained and/or knotted logs are encountered, such restraint is most difficult to provide. Further, when such difficult splitting is encountered, a clearing of the splitting device by reverse movement or the like from the log may be a difficult procedure.

The second arrangement, wherein the log is urged by a hydraulic ram or the like into either a knife or wedge arrangement, provides an advantageous "self clearing" feature. This feature obtains inasmuch as the movement of a succession of logs through the splitting station tends to push debris or unsplit log portions past the splitting knives. As examples of the latter arrangement, reference is made to U.S. Pat. Nos. 3,974,867; 3,077,214; and 3,242,955.

In consequence of the significant weight factor involved in the movement and manipulation of logs, it is desirable that the cutting and splitting arrangement, i.e., the apparatus for preparing logs, be reasonably compact and readily moveable to the site of a fell. Accordingly, the common practice is to mount the systems upon vehicle drawn trailers or the like, as shown, for example, in U.S. Pat. Nos. 3,995,672; 3,077,214; 3,640,323; 3,356,115; and 3,242,955.

As noted above, the procedure for the cutting and splitting of logs suited for common fireplace usage involves the exertion of considerable effort, exhaustion of the operators following four or five hours of effort in the field not being an uncommon observation. This physical effort entails a repeated bending over and lifting of logs for cutting and splitting. With several devices heretofore proposed, more than one pass is required to split a single log into an adequate number of segments. This procedure requires manual lifting and replacement.

Probably, to minimize the amount of power required in log splitting, certain of the arrangements, particularly those utilizing similtaneous multi-log segment splitting configurations, operate with the noted knife structures as opposed to wedge structures. The utilization of knives, however, leads to difficulties in maintaining the proper axial alignment of a log being urged into the knives, the knives being more prone than wedge configurations to cause off-center splitting. The utilization of wedges within a splitting station, however, heretofore has been observed to promote binding between split segments and the apparatus itself during the splitting prodcedure. A particular difficulty encountered in utilization of wedge structures for multiple, i.e. four-way splitting systems resides in the tendency of the splitting segments to move transversely outwardly, causing both misalignment of the split as well as a failure to properly engage transversely or horizontally oriented wedge components. In consequence, simultaneous multiple splitting of segments of a log has not found particular favor in the industry.

Maintaining proper alignment of the logs within the splitting apparatus is burdensome, often requiring additional, physical expenditure on the part of labor. Binding difficulties are often encountered during the splitting process to the extent that knife or wedge containing splitting stations heretofore have been positioned as to provide for the immediate dropping or passage of split log segments freely to the ground level. This, of course, requires that the operator subsequently bend fully to the ground to pick up the segments for placement in trucks and the like. Each maneuver added to the log preparation procedure may be observed to restrict ultimate productivity, worker exhaustion relatively early in a given working day the consequence of necessary steps of lifting, moving, stabilizing and stacking from ground level. It follows that minimization of required operator steps will advantageously improve field productivity.

SUMMARY

The present invention is addressed to an improved apparatus for preparing logs for common fireplace usage. Advantageously minimizing the requisite number of labor intensive procedures now present in the art as well as the extent of manual lifting, holding and stabilizing as well as the moving of logs and split segments thereof, the apparatus serves to enhance production capability in the fireplace log preparation field of endeavor. Utilizing one or more hydraulic rams to urge logs cut to appropriate length into a splitting station, the apparatus advantageously provides four-way severence of the logs with a composite wedge configuration. This simultaneous multiple splitting is carried out without generating the above described binding phenomenon and the attendant necessity of a structural configuration serving to drop split log segments to ground level in conjunction with the splitting procedure. With the present invention, split log segments are automatically collected at a receiving platform conveniently positioned at a height serving to eliminate the labor requirement of bending to the ground level to pick them up.

Another aspect and object of the invention resides in the provision of a composite, four-way splitting wedge assembly which controls the outward transverse movement of half log segments during the splitting procedure. In this regard, the unique composite wedge structure of the invention is configured having horizontally disposed transverse wedges, the splitting edges of which extend from a vertical wedge at an acute angle with respect to the axis of movement of a log being split. The transverse wedges initially engage the log being split along their outwardly disposed portions. By virtue of their symmetrical angular orientations, force vectors are derived during splitting which serve to maintain half log segments in an efficient position for practical splitting.

Another object and feature of the invention is to provide apparatus of the type described incorporating a frame upon which is mounted a hydraulic ram arrangement having a piston with a log engaging plate providing an assembly which is reciprocally moveable between retracted and extended positions along a given axis. Upon the frame there is mounted an elongate platform which has an upwardly disposed surface arranged in parallel with the axis of the ram piston and which is positioned a predetermined distance therebelow. The elongate platform is formed having a width of sufficient extent for temporarily properly supporting logs placed thereon in preparation for splitting. The platform terminates, preferably in tapering fashion, at the entrance to a composite log splitting wedge assembly, also fixed to the frame. A receiving platform is positioned beneath the noted elongate platform as well as beneath the composite wedge assembly which receives log segments split while passing through the wedge assembly. The receiving platform preferably is elongate and of a generally trough-shaped configuration and progressively collects log segments as they are formed.

A motor mounted upon the frame of the apparatus serves to drive a hydraulic pump which, operating through a manually actuated valve, serves to provide control over and power to the hydraulic ram described above.

Another object of the invention is to provide apparatus of the type described which further includes a saw frame pivotally mounted upon the frame of the entire assembly and which rotates about a pivotal connection between an operative orientation resting upon the ground surface and an inoperative orientation which is utilized during transportation of the apparatus. A circular, cross-cut saw is mounted upon the saw frame and so also is a pivotal feed platform. A hydraulic actuator or cylinder is mounted between the assembly frame and saw frame and is operated in association with the hydraulic pump driven from the motor mounted upon the apparatus to move the saw frame between the noted operative and inoperative orientations. Drive for the circular saw is provided from the noted motor. The combined sawing feature permits accurate right angular cutting of the logs into splitting lengths to provide assured proper introduction thereto into the noted composite wedge assembly. Additionally, the hydraulic actuation of the device serves to relieve the burden upon operators for a requirement of lifting heavy equipment at the close of a day of effort.

Other objects of the invention will, in part, be obvious and will, in part appear hereinafter.

The invention, accordingly comprises the apparatus possessing the construction, combination of elements and arrangement of parts which are exemplified in the following detailed disclosure. For a fuller understanding of the nature and object of the invention, reference should be had to the following detailed description taken in connection with the accompanying drawings.

DETAILED DESCRIPTION

Figure 1:
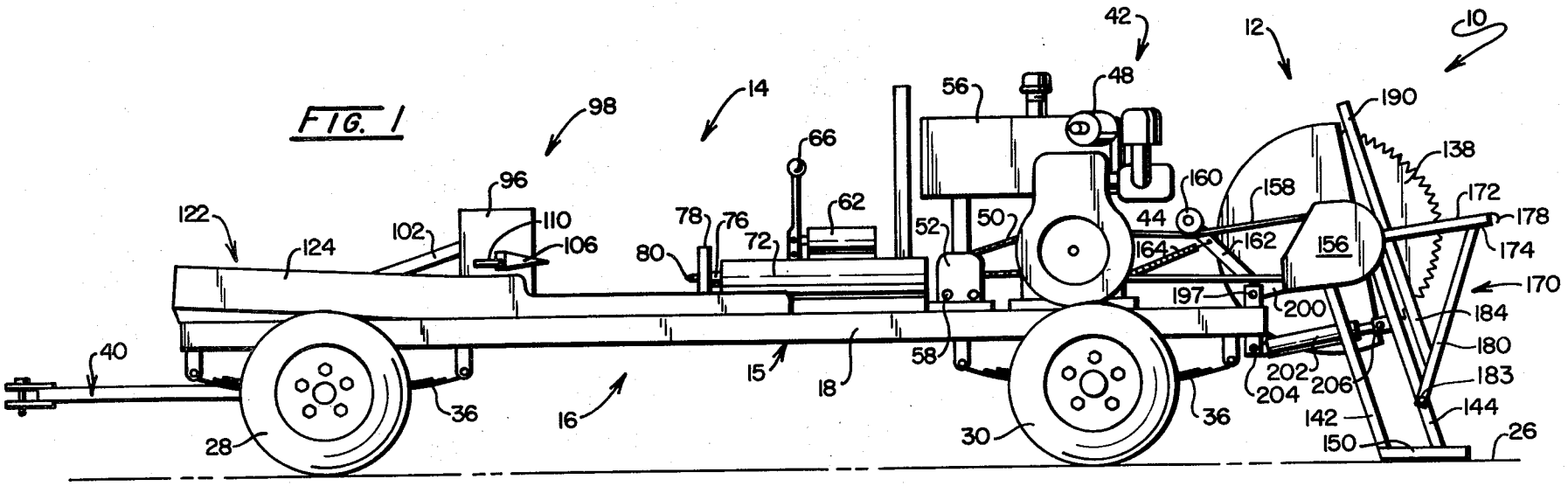
FIG. 1 is an elevational view showing one side of the apparatus of the invention with a saw frame portion thereof illustrated in an operative orientation.
Figure 3:
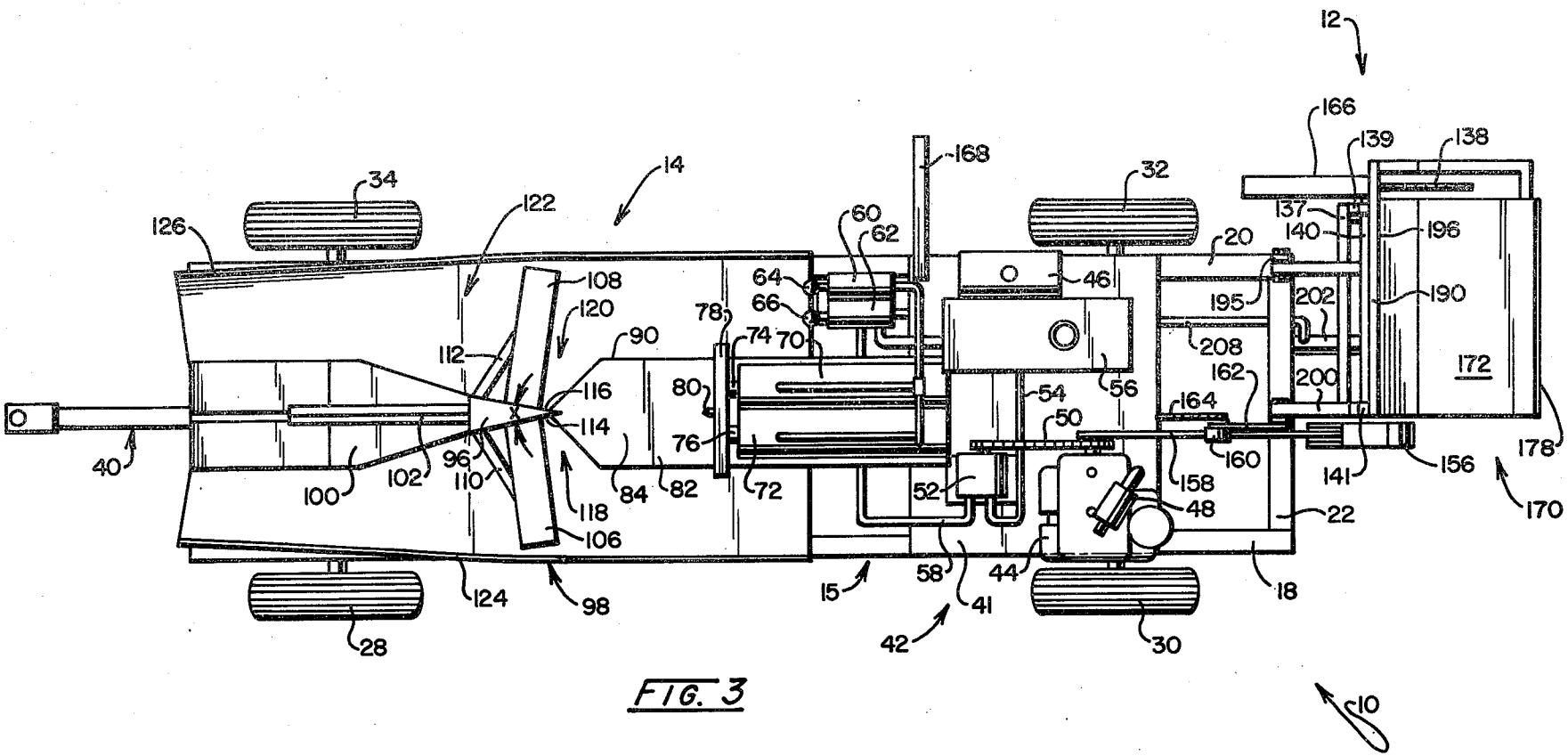
FIG. 3 is a top view of the apparatus of FIGS. 1 and 2.
Figure 4:
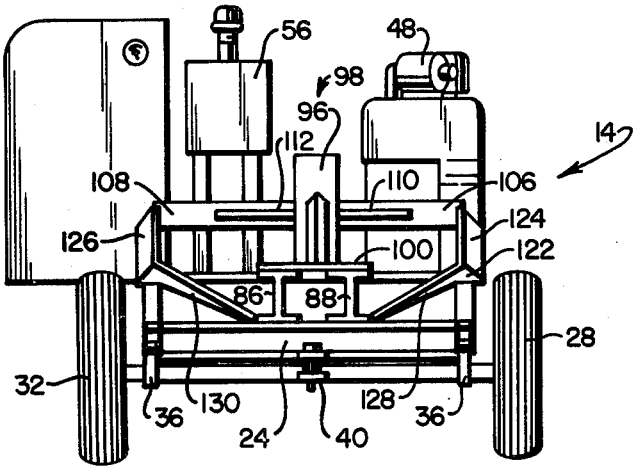
FIG. 4 is a front elevational view of the apparatus of FIGS. 1 and 2.

Looking to FIGS. 1 and 3, the apparatus of the invention is revealed generally at 10. Apparatus 10 incorporates two principal features for preparing logs for fireplace usage. These features are: (a) a cross-cut sawing arrangement, shown generally at 12; and (b) a four-way log splitting feature, represented generally at 14. These operational features are shown to be mounted upon a four wheel trailer 16 which is formed in conventional fashion including a frame 15 having elongate side beams or channels 18 and 20 as well as transversely oriented beams, a rearward one of which is shown at 22 in FIG. 3 and a forwardly disposed one of which is shown in FIG. 4 at 24. Frame 15 is supported above ground surface level, represented at 26, by four wheels, 28, 30, 32 and 34. These pneumatic wheels are freely rotatable and mounted in conventional fashion by axle supporting leaf spring mountings as at 36.

Wheels 28 and 34 may be considered as forwardly disposed and are arranged for turning from a conventional yoke assembly, shown generally at 40. Assembly 40 is suited for providing attachment with a tow truck or the like.

Mounted upon frame 15 in the vicinity of rear wheels 30 and 32 is a common power station, denoted generally at 42. Station 42 includes a gasoline fueled internal combustion engine 44 having conventional appurtenances such as a gas tank 46 (FIG. 3) and muffler 48. FIG. 3 further reveals the power or drive output of motor 44 as including a sprocket and chain assembly 50 one drive side of which is connected to the inwardly disposed portion of the output drive shaft of the motor. Drive assembly 50 extends in conventional fashion to the input of a hydraulic pump 52. Also fixed to the frame 15 of trailer 16, pump 52 includes an input hydraulic fluid conduit or hose 54 extending from a reservoir tank 56 which serves to retain hydraulic fluid in conventional fashion. The fluid output of pump 52 is coupled to a conduit 58 which extends to hand actuated valves 60 and 62. Valve 60 is of the conventional, centrally fed, dual directional actuating variety, developing a hydraulic powering output from either of two output conduits depending upon the direction of the hand actuation thereof, as through handle 64. Valve 62, actuated from handle 66, may be of a unidirectional powering variety with a corresponding pressure relief operation. The particular positioning of hydraulic fluid-carrying conduits is one of design choice, being dependant upon the particular type of valves and pumps selected for utilization with the apparatus. Accordingly, the positioning or presence of such conduits is illustrated in the drawings in somewhat schematic fashion in the interest of enhancing the clarity thereof.

One of the noted valves, for example valve 60, functions in connection with four-way log splitting feature 14. In this regard, feature 14 includes two parallel disposed hydraulic rams 70 and 72 fixed to the frame 15 of trailer 16 such that their respective reciprocally drivable piston rods 74 and 78 are moveable in symmetry along and about a horizontal axis generally bisecting the longitudinal center line of the frame 15. Piston rods 74 and 76 coact to operate simultaneously and each is coupled to a common log engaging fixture present as a pusher plate 78. Plate 78 incorporates a small nib or protrusion 80 utilized for securing engaged logs against rotation to an off-axis position.

Pusher plate 78 rides over and extends perpendicularly upwardly from a somewhat elongate platform 82, the upward surface of which at 84 extends a predetermined distance beneath protrusion 80 as well the axis of movement of piston rods 74 and 76. This distance is selected so as to provide for an engagement by protrusion 80 with the central portion of logs of conventionally encountered diameter, i.e. ranging from about 10 inches to about 24 inches. As revealed in FIGS. 3, 4 and 6, platform 82 is supported by parallel I-beams as at 86 and 88 which extend longitudinally along the forward and mid portions of trailer 16. The generally horizontally disposed surface 84 extends from the noted vicinity of hydraulic ram arrangement to a terminal portion thereof at 90. Look particularly to FIGS. 3 and 6, it may be observed that portion 90 is configured having a triangular shape or taper leading to a point terminus positioned at the leading, splitting edge of a vertical wedge 96 of a composite log splitting wedge assembly, represented generally at 98. Vertical wedge 96 extends perpendicularly to upward surface 84 and, for example, is attached by welding to a steel plate 100 forwardly disposed from platform 84. Additional support for wedge 96 is provided by angular brace 102 welded between plate 100 and the rear surface of wedge 96.

Figure 6:
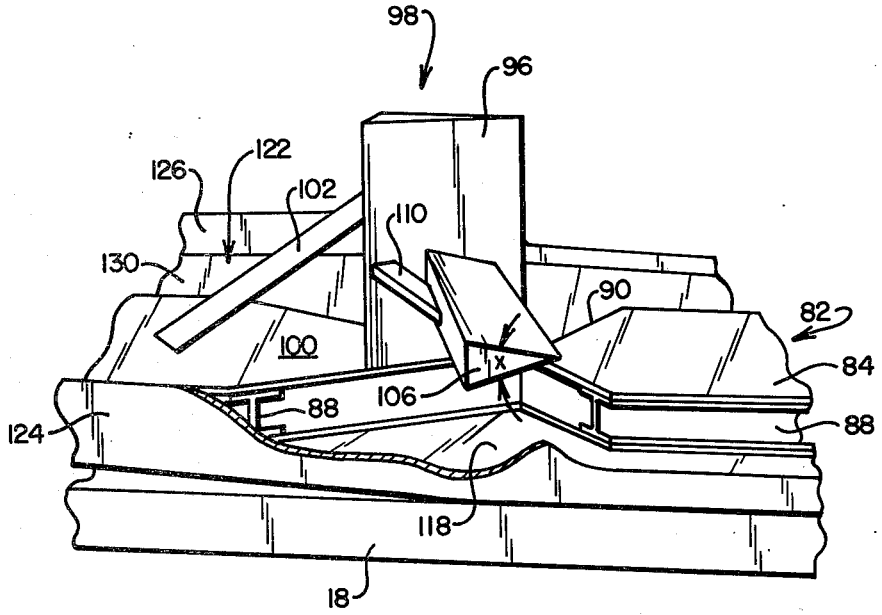
FIG. 6 is a partial pictorial representation of a composite log splitting wedge assembly of the invention.

Extending outwardly from the inclined surfaces of wedge 96 are two symmetrically disposed, transversely oriented wedges 106 and 108. These wedges are attached to wedge 96 by welding and are further supported, respectively, by angular steel braces 110 and 112 depending from the rearwardly disposed surface of wedge 96. The splitting edges of each transverse wedge 106 and 108 is positioned in a plane parallel to platform surface 84, i.e. horizontally. Additionally, each of the wedges is aligned with respect to that plane such that the internal angle of the wedge, denoted, x, in FIG. 6, is bisected by a generally horizontal plane parallel with surface 84 to assure symmetrical splitting action in the course of splitting operations. Of importance, it may be noted that the splitting edges of transverse wedges 106 and 108 intersect the sides of wedge 96 at respective and corresponding symmetrically disposed points 114 and 116 which are spaced rearwardly in a splitting sense from the splitting edge of wedge 96. Of particular importance, each of the splitting edges of wedges 106 and 108 are canted forwardly from points 114 and 116. This forward cant represents a predetermined acute angle with respect to the central axis described above along and about which pistons 74 and 76 travel in spaced symmetry.

The rationale for the noted acute angle or forward angular disposition of transverse wedges 106 and 108 follows from a consideration of a typical splitting operation. During such operation, a log of suitable length to be split is placed upon platform surface 84. This surface is selected having a width suitable to retain the log placed thereon with stability usually being assured by the light touch of the operator's hand on top of the log. Handle 64 of valve 60 then is actuated and rams 70 and 72 are actuated to cause pusher plate 78 to move outwardly along the noted axis of the system. The log then is thrust into the forwardly disposed splitting edge of wedge 96. Accordingly, the initial splitting action on the log is concentrated only along one splitting edge surface to preserve power. As the log then commences to split, the half segments undergoing splitting move toward the splitting edges of transverse wedges 106 and 108. Because of the angular orientation of wedges 106 and 108, their outwardly disposed regions first make contact with the half-log segments. This contact creates a force vector which tends to hold the four segments of the log undergoing splitting in reasonably close adjacency such that the half segments do not merely "ride out" on the splitting edges of the transverse wedges and fail to split along their entire length. Such situation otherwise would be encountered, particularly in view of the use of wedges as opposed to knife type devices. Accordingly, with the instant invention, the advantages of a wedge-type splitting arrangement are derived while the logs are retained in appropriate orientations to assure their complete splitting. The internal included angle extending from the splitting edges of all wedges, heretofore denoted by the letter "x" in connection with FIG. 6, preferably is selected from within an angular range of about 20°–45°, while the elevation of the splitting edges of wedges 108 and 109 above surface 84 is selected between about 4 and 10 inches.

As indicated earlier, another difficulty arises, particularly in the utilization of wedge type splitting structures, in that the lower segments of the logs being split tend to jam into the machinery and stop production until such time as the jammed log segments can be released. To accommodate for this, the general practice heretofore has been to provide the splitting stations unencumbered orientations wherein the logs drop directly to the ground surface following splitting. Unfortunately, this arrangement requires that the logs be picked up before building to a pile thereof of any significant height. Further, the operators of the apparatus are required to bend further in picking up the split segments, a procedure accelerating fatigue over a given work period. With the instant invention, such lower log segment binding is eliminated and the log segments are automatically maneuvered along a receiving platform, from which, with less fatigue they may be transferred to a vehicle such as a truck or suitable conveyance system.

Looking to FIGS. 3 and 6, the arrangement of the invention serving to eliminate binding difficulties is revealed. Note in the figures, that terminal portion 90 of platform 82 tapers to a point configuration at the splitting edge of vertical wedge 96. Additionally, plate 100 upon which wedge 96 is welded is cut away in correspondence with the taper of the sides of wedge 96. As a consequence, gaps 118 and 120 are defined in the vicinity of composite log splitting assembly 98. Adequate room for the lower quarter segments of any log being split to move downwardly and sufficiently freely for full splitting action is provided. Note, additionally, that the logs do not fall to ground surface 26 but are received in sequential fashion upon a receiving platform denoted generally at 122. Platform 122 is fixed to the frame 15 of trailer 16 and is formed having a generally shallow, trough-like configuration, including upwardly disposed sides 124 and 126 and bottom portions 128 and 130 (FIG. 4). Note additionally, that the trough is supported at a level below that of platform 82 but sufficiently high to facilitate the manual picking up of split log segments. Further, as successive log segments are developed, succeeding segments will tend to push prior segments along platform 122 toward the front of trailer 16.

Figure 5:
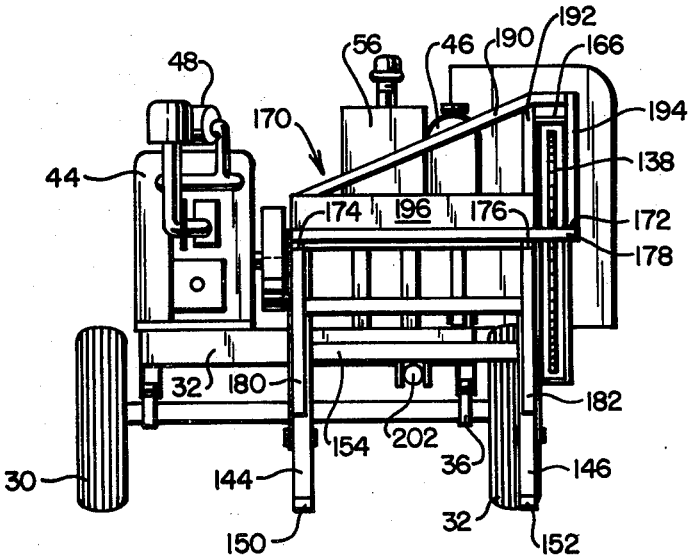
FIG. 5 is a rear elevational view of the apparatus of FIG. 1.

Looking now to the cross-cut saw arrangement 12 affixed to the rearwardly disposed portion of trailer 16, FIGS. 1–3, 5 and 7 show a circular cross-cut saw 138 mounted upon a drive shaft 140 (FIGS. 3 and 5). Drive shaft 140 is mounted through bearings 139 and 141 as revealed in FIG. 3. Bearings 139 and 141, in turn, are fixed to a channel type support 137. Support 137 is weldably fixed to a frame generally comprised of four angular struts or legs, three of which are revealed at 142, 144 and 146. These legs are interconnected by ground support angles or bars as at 150 and 152 (FIG. 5) as well as by transversely connected braces one of which is revealed at 154. Rotational drive to shaft 140 is provided by a belt driven pulley enclosed within a protective sheath or cover 156. FIGS. 1 and 5 show the cross-cut saw arrangement 12 in an "operative" orientation wherein power is supplied thereto from the output of motor 44 to drive shaft 140. As revealed in FIG. 3, this power insertion is carried out by a belt 158 extending from engagement with an outwardly disposed pulley (not shown) fixed to the output shaft of the motor to a corresponding pulley fixed to drive shaft 140. An idler pulley rotatably mounted upon lever 162 which in turn, is pivotally mounted upon the frame 15 of trailer 16 serves to properly tension belt 158 for appropriate drive operation. Tensioning is carried out through the bias of a coil spring 164 extending from a spring ground connection at frame 15 to the uppermost portion of lever 162. To provide for occupational safety, a conventional circular saw cover 166 is mounted for pivotal movement about saw 138. Cover 166 is weight biased to pivot over blade 134 in conventional fashion. In the same regard, a panel 168 is erected adjacent valves 60 and 62 to provide protection for the operator utilizing those valves at such time as the circular saw 138 is being driven.

Logs are introduced into the cutting teeth of saw 138 by a feed frame 170 pivotally mounted upon the saw frame. The feed frame 170 is formed of a sheet metal platform 172 supported upon braces 174 and 178 as well as transversely oriented pipe support 178 extending therebetween. Braces 174 and 176, in turn are connected to supporting legs 180 and 182 as well as the forward frame legs, one of which is revealed in FIGS. 1 and 2 at 184.

Figure 7:
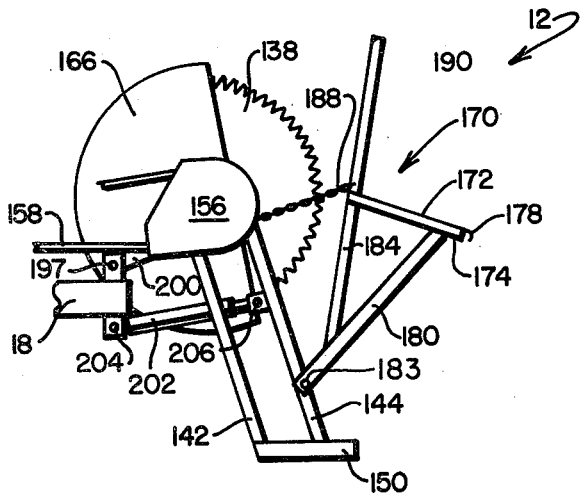
FIG. 7 is a partial side elevational view of the saw frame feature of the invention.

Legs 180 and 182, respectively, are pivotally mounted at 183 to saw frame legs 144 and 146 and the feed frame assemblage 170 is restrained from excessive outward pivotal movement by a chain 188 (FIG. 7). FIG. 5 further reveals the presence of a triangular shaped handle portion, including hand graspable angle member 190, which is weldably connected to two upstanding members 192 and 194 which are arranged such that, when feed frame 170 is pivotally moved toward saw blade 138, they serve to pass over and frame the blade while simultaneously rotating cover 166 to a position permitting the cutting operation. A back plate 196 serves to provide a nitch within which the logs to be cross-cut are positioned in nesting fashion.

The entire saw frame, including associated feed frame 170, is pivotally mounted upon the frame 15 of trailer 16. Looking to FIGS. 1–3 and 7, this pivotal connection is shown to be provided by bolts extending through respective upstanding flanges 195 and 197 welded to frame member 22 and one end of connector bars 198 and 200. Bars 198 and 200, in turn, are welded to the saw frame assembly 12 and the entire assembly may be pivoted from for operational orientation shown in FIG. 1 to the transporting or inoperative orientation shown in FIG. 2. Again in the interest of alleviating the physical effort required in setting up the saw assembly, a hydraulic cylinder 202 is provided within the assembly. The housing end of cylinder 202 is pivotally connected to a downwardly extending flange 204 attached to the underside of frame member 22, while the piston rod thereof is coupled to a flange 206 which is weldably coupled to transverse brace 154 of the saw frame. A hydraulic input to cylinder 202 is schematically represented by conduit 208 in FIG. 3 which is coupled to hand actuated valve 62. As is apparent, when the trailer 16 is in position for operation, the operator manipulates handle 66 to lower the assembly 12 into its operational position. Drive belt 158 then is coupled with the output of motor 44 to provide drive to saw blade 138. The feed frame 170 then is pivoted to the orientation shown in FIG. 7 and a log is positioned thereon, whereupon the frame then is pivoted toward blade 138 to provide cross cutting of the logs to an appropriate length. The utilization of this form of crosscutting is advantageous, inasmuch as the cuts are properly made in perpendicular orientation with respect to the axis of each log. This assures proper insertion of the log into the composite wedge assembly 98.

Figure 2:
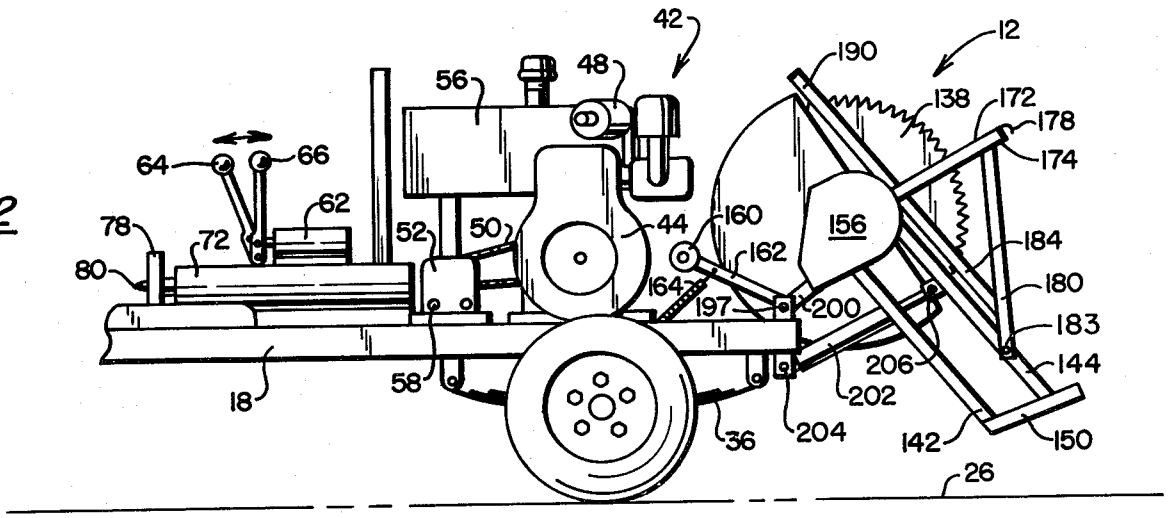
FIG. 2 is a partial elevational view similar to FIG. 1 but showing the saw frame components thereof in an inoperative or transporting orientation.

Upon completion of a day's field work, the saw frame assembly is urged into the orientation of FIG. 2 for transportation by trailer 16. This is carried out by an appropriate manipulation of lever 66 of valve 62 to cause the extension of the piston rod of hydraulic cylinder 202.

When the trailor arrives in the field it will appear as shown in FIG. 2. The first operation will be the pivoting of the feed frame 170 to a position as shown in FIG. 1. This is accomplished by actuating valve 62 such that cylinder 202 discharges fluid through conduit 208. As frame 170 descends it pivots in an arc from its connection to flanges 195 and 197 until ground support bars 150 and 152 rest on the ground 26.

After the motor is started and belt 158 is turning saw 138 and it is desired to cut logs into short pieces prior to splitting, angle member 190 is grasped and the feed frame is pulled toward the operator which is to the right as shown in FIG. 7. Metal platform 172, supporting legs 180, 182, forward frame legs 184 and angle member 190 are all rigidly connected together and they pivot as a unit about pivot 183 mounted on legs 144 and 146. Chain 188 limits the outward pivoting. A log will be deposited on platform 172 and the operator will place his hands on the log over the platform and push it toward the rotating saw 138. The frame will rotate about pivot 183 and the log projecting beyond platform 172 will be severed by the saw 138 for later splitting.

After all the cutting and splitting are finished in a given location and the apparatus is to be moved the actuating valve 62 will be manipulated to inject fluid into cylinder 202 to pivot the frame 170 from its FIG. 1 position to its FIG. 2 position and then the motor will be turned off.

Since certain changes may be made in the above described system, apparatus and method without departing from the scope of the invention herein involved, it is intended that all matter contained in the description thereof or shown in the accompanying drawings shall be interpreted as illustrative and not in a limiting sense.

What is claimed is:

1. Apparatus for preparing logs for fireplace usage and the like comprising:

a frame;

means for supporting said frame a select distance above ground surface;

hydraulic ram means mounted upon said frame and having piston rod means extensible and retractable with respect thereto along a given axis;

log engaging means fixed to and moveable with an outwardly disposed end of said piston rod means;

an elongate platform fixed to said frame, having an upwardly disposed surface parallel to said given axis, positioned a predetermined distance below said axis, having a width of sufficient extent for temporarily supporting logs placed thereon with stability and in substantial alignment with said given axis, and having a predetermined length extending from the vicinity of said hydraulic ram means to a terminal portion adjacent a composite log splitting wedge assembly, said terminal portion tapering to a point at said assembly said assembly being fixedly mounted upon said frame and including a vertical wedge of predetermined internal angular extend having a splitting edge extending substantially from and normally to the plane of said elongate platform surface in substantial alignment with said given axis, and first and second transverse wedges of predetermined internal angular extent respectively fixed to and extending in symmetrically disposed fashion from oppositely disposed surfaces of said vertical wedge, each said first and second transverse wedges having a splitting edge extending a predetermined distance above and substantially parallel with said elongate platform surface from respective points spaced a predetermined distance from said vertical wedge splitting edge and at a predetermined acute angle with respect to said given axis, said acute angle being selected such that the outwardly disposed portions of said transverse wedge splitting edges contact a log urged into said wedge assembly prior to contact therewith by corresponding inwardly disposed portions of said transverse wedge splitting edges;

motor means mounted upon said frame for providing a drive output;

pump means mounted upon said frame and responsive to said motor means drive output for applying fluid under pressure to said hydraulic ram means; and valve means actuable for controlling said application of fluid under pressure to said hydraulic ram means.

2. The apparatus of claim 1 including crosscut sawing means comprising:

a saw frame pivotally mounted upon said assembly frame and rotatable about said saw mounting from an inoperative transporting orientation to an operative orientation resting upon the ground surface;

a drive shaft rotatably mounted upon said saw frame;

a circular cross-cut saw mounted upon said drive shaft;

feed frame means pivotally mounted upon said saw frame for supporting lengths of a log having an axis, said axis being generally parallel to the drive shaft;

means for rotatably driving said drive shaft from said motor means when said saw frame is in said operative position; and hydraulic actuator means connected between said saw frame and said assembly frame, operatively associated with said pump means and said valve means for rotating said saw frame between said operative and inoperative orientations.

3. The apparatus of claim 1 in which:

said first and second transverse wedges of said composite log splitting wedge assembly are spaced above said elongate platform upwardly disposed surface a distance selected between about 4 and 10 inches, and including receiving platform means fixed to said frame, extending from said composite wedge assembly and positioned a predetermined distance beneath the level of said elongate platform for receiving segments of logs split by passage through said composite log splitting wedge assembly.

4. The apparatus of claim 3 in which the respective said splitting edges of said first and second transverse wedges are spaced rearwardly from the said splitting edge of said vertical wedge a distance sufficient to provide for splitting contact by said vertical wedge prior to splitting contact thereof by said outwardly disposed portions of said splitting edges of said first and second transverse wedges.

5. The apparatus of claim 1 in which said internal angular extent of said vertical wedge and said first and second transverse wedges is selected from within a range of about 20° and 45°.

6. The apparatus of claim 1 in which said log engaging means:

comprises a steel push plate having at least one generally pointed protrusion extending outwardly therefrom for effecting a non-slipping engagement with a said log.

7. The apparatus of claim 3 in which said receiving platform means is present as an elongate trough extending in substantial alignment with said given axis from a position beneath said composite wedge assembly.

8. The apparatus of claim 4 in which:

said receiving platform means is present as an elongate trough extending in substantial alignment with said given axis from a position beneath said composite wedge assembly.

9. The apparatus of claim 8 in which the respective said splitting edges of said first and second transverse wedges are spaced rearwardly from the said splitting edge of said vertical wedge a distance sufficient to provide for splitting contact by said vertical wedge prior to splitting contact thereof by said outwardly disposed portions of said splitting edges of said first and second transverse wedges.

* * * * *